US010845742B2

(12) United States Patent
Kawai et al.

(10) Patent No.: US 10,845,742 B2
(45) Date of Patent: Nov. 24, 2020

(54) IMAGE FORMING APPARATUS

(71) Applicant: CANON KABUSHIKI KAISHA, Tokyo (JP)

(72) Inventors: Hiroki Kawai, Abiko (JP); Mitsuru Hasegawa, Tsukubamirai (JP); Suguru Takeuchi, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/822,416

(22) Filed: Mar. 18, 2020

(65) Prior Publication Data

US 2020/0310309 A1 Oct. 1, 2020

(30) Foreign Application Priority Data

Mar. 29, 2019 (JP) ..... 2019-065190

(51) Int. Cl.
*G03G 15/20* (2006.01)

(52) U.S. Cl.
CPC ..... *G03G 15/2039* (2013.01); *G03G 15/2028* (2013.01)

(58) Field of Classification Search
CPC ..... G03G 15/2028; G03G 15/2039; G03G 15/2046; G03G 15/205
See application file for complete search history.

(56) References Cited

U.S. PATENT DOCUMENTS 8,774,667 B2 * 7/2014 Mukai ..... G03G 15/2039 399/70
2013/0195493 A1 * 8/2013 Hase ..... G03G 15/205 399/69

FOREIGN PATENT DOCUMENTS

JP 63313182 A 12/1988
JP 2010217218 A 9/2010
JP 201531891 A 2/2015

* cited by examiner

*Primary Examiner* — Hoang X Ngo
(74) *Attorney, Agent, or Firm* — Venable LLP

(57) ABSTRACT

An image forming apparatus includes a fixing unit and a control unit. The fixing unit includes a rotating endless belt, a rotary member, a heating member, a driving unit, and a separation member arranged facing a circumference of the endless belt and configured to separate the recording material, after passing through the nip portion, from the endless belt. The control unit is configured to control the driving unit such that the endless belt stops along with an end of a fixing processing and rotates when a temperature of the endless belt passes a glass transition temperature of the endless belt from higher than the glass transition temperature of the endless belt to lower than the glass transition temperature of the endless belt.

15 Claims, 12 Drawing Sheets

IMAGE FORMING APPARATUS

BACKGROUND OF THE INVENTION

Field of the Invention

The present invention relates to an image forming apparatus.

Description of the Related Art

A fixing unit furnished in an image forming apparatus which employs such as an electrophotographic system and an electrostatic recording system fixes a toner image on a recording material by passing the recording material bearing the toner image through a nip portion and heating the toner image on the recording material. As this sort of the fixing unit, an on-demand system which starts an apparatus quickly is offered (refer to Japanese Patent Laid-Open No. S63-313182 and Japanese Patent Laid-Open No. 2010-217218). In the on-demand system, the toner image is heated via a fixing belt (endless belt) of a small heat capacity.

On the other hand, in the case of a configuration of such fixing belt as described above, there are cases where the fixing belt flaps during a rotation. When the fixing belt rotates with flapping as described above, there is a possibility that the fixing belt interferes with a separation member for a separation of the recording material from the fixing belt and generates a scratch on a surface of the fixing belt. This is caused by the fixing belt stopped rotation along with the end of a fixing processing and a temperature of the fixing belt crossing a glass transition temperature, where the fixing belt remembers a shape (develops a kink), from a high temperature side to a low temperature side.

Accordingly, a control system in which, at stopping rotating the fixing belt along with the end of a fixing processing, the fixing belt is controlled to continue rotation until the temperature of the fixing belt having fallen below the glass transition temperature to prevent remembrance of the shape causing a flap is offered (Japanese Patent Laid-Open No. 2015-31891).

However, if the fixing belt continues rotation after the end of every fixing processing until the temperature of the fixing belt having fallen below the glass transition temperature, total running time of the fixing belt is significantly increased in comparison with no such control processing case.

Life of the fixing belt is limitedly determined by the amount of wear caused by sliding friction with a sliding unit. Therefore, an implementation of the control system described above may cause to shorten the life of the fixing belt since an increase in the total running time of the fixing belt will proportionally accelerate the wear.

SUMMARY OF THE INVENTION

According to one aspect of the present invention, an image forming apparatus includes a fixing unit including a rotating endless belt, a rotary member configured to form a nip portion with the endless belt and rotate, a heating member configured to heat the endless belt, a driving unit configured to rotatably drive at least one of the endless belt and the rotary member to convey a recording material at the nip portion, and a separation member arranged facing a circumference of the endless belt and configured to separate the recording material, after passing through the nip portion, from the endless belt, and a control unit configured to control the driving unit such that the endless belt stops along with an end of a fixing processing and rotates when a temperature of the endless belt passes a glass transition temperature of the endless belt from higher than the glass transition temperature of the endless belt to lower than the glass transition temperature of the endless belt.

Further features of the present invention will become apparent from the following description of exemplary embodiments with reference to the attached drawings.

DESCRIPTION OF THE EMBODIMENTS

An embodiment according to the present invention will be described below with reference to the drawings.

First Embodiment

Image Forming Apparatus

Figure 1:
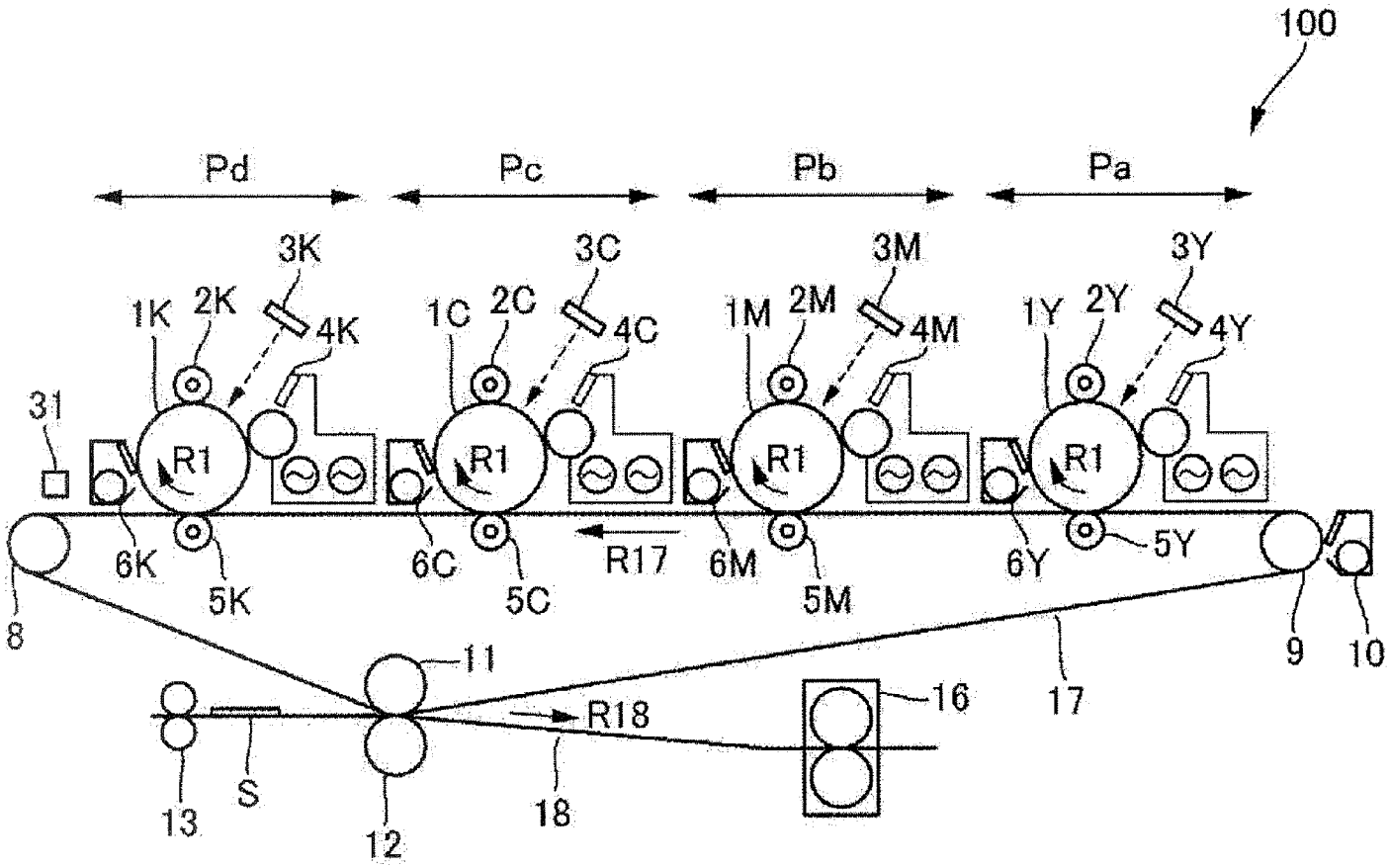
FIG. 1 is a schematic cross-sectional configuration diagram of an image forming apparatus according to a first embodiment of the present invention.

An image forming apparatus 100 of this embodiment is a copy machine, a printer, a facsimile, or a multi-function printer having a plurality of these functions, etc., and FIG. 1 illustrates a full color image forming apparatus of 4 colors of an electrophotographic system equipped with 4 image forming units.

That is, in the image forming apparatus 100, the 4 image forming units (image forming stations) Pa, Pb, Pc, and Pd are arranged along an intermediate transfer belt 17 of an intermediate transfer unit from an upstream side to a downstream side in a rotational direction of the intermediate transfer belt 17 (in an arrow R17 direction). Each of the image forming units Pa, Pb, Pc, and Pd is an image forming unit which forms an image in color of yellow, magenta, cyan, and black in this order, and includes a photosensitive drum as an image bearing member (an electrophotographic photosensitive member) 1Y, 1M, IC, and 1K. As configurations of the image forming units Pa, Pb, Pc and Pd are almost same, a subscript (Y, M, C, K) which corresponds to constituents of the image forming units will be omitted in further descriptions.

The photosensitive drum 1 is drivingly rotated in an arrow R1 direction (in the clockwise direction in FIG. 1). In a peripheral of the photosensitive drum 1, a charge roller (a charge unit) 2, an exposing unit (a latent image formation unit) 3, a development device (a development unit) 4, a primary transfer roller (primary transfer unit) 5, and a drum cleaner (a cleaning unit) 6 are arranged approximately in sequence along the rotational direction of the photosensitive drum 1. Also, a transfer conveyor belt 18 is arranged under the intermediate transfer belt 17 in FIG. 1, and a fixing unit (fixing unit) 16 is arranged at a downstream side in a conveyance direction (in arrow R18 direction) of a sheet (recording material) S such as a sheet of paper.

In this embodiment, for example, the photosensitive drum 1 of 30 mm in diameter is used. The photosensitive drum 1 is coated with a photosensitive layer composed of an ordinary organophotoconductive (OPC) layer over a circumference of a drum substrate made of an electric conductive material such as a grounded aluminum. In this photosensitive layer, an under-coating layer (UCL), a charge carrier generation layer (CGL), and a charge carrier transfer layer (CTL) are laminated. The photosensitive layer is ordinarily an insulating layer, but has a characteristic to turn conductive by irradiating a light of a special wavelength. This is because when the light is irradiated, electron holes are generated in the charge carrier generation layer, and those holes become a carrier of a flow of an electric charge. The charge carrier generation layer is, for example, a phthalocyanine compound of 0.2 μM thickness, and the charge carrier transfer layer is, for example, composed by polycarbonate of approximately 25 μm thickness with dispersing a hydrazone compound.

The charge roller 2 is arranged to abut on a surface of the photosensitive drum 1. The charge roller 2 has a conductive core metal in the center, and a conductive elastic layer, a medium resistance conductive layer, and a low resistance conductive layer are formed on a circumference of the core metal. Both ends of the charge roller 2 are rotatably supported by bearings (not shown), and the charge roller 2 is arranged in parallel with a rotational axis of the photosensitive drum 1. The bearings at both ends of the charge roller 2 are in pressure contact with the photosensitive drum 1 by pressed with a proper pressing force provided by an elastic member such as a spring (not shown). The charge roller 2 is drivingly rotated by rotation of the photosensitive drum 1 by a force of the pressure contact. And, a surface of the photosensitive drum 1 is charged by charging the charge roller 2 with a predetermined charge bias.

The exposing unit 3 is a laser scanner that turns on and off to irradiate a laser beam in accordance with image information. The laser beam generated in the exposing unit 3 scans and exposes on a surface of the photosensitive drum 1 via a reflecting mirror. This removes charges on a portion irradiated with the laser beam, and an electrostatic latent image is formed on the surface of the photosensitive drum 1.

The development unit 4 stores a two-component developer of a non-magnetic toner and a magnetic carrier. At an opening portion of the development unit 4 facing the photosensitive drum 1, a development sleeve is rotatably provided. By charging a predetermined development bias on the development sleeve, the electrostatic latent image formed on the photosensitive drum 1 is developed by a toner. Above the development unit 4, a toner container (not shown) for replenishment of the toner is detachably provided. The toner consumed in development is replenished to the development vessel of the development unit 4 from the toner container.

Over the primary transfer roller 5 and a secondary transfer counter roller 11, the intermediate transfer belt 17 of an endless shape is bridged. The intermediate transfer belt 17 is pressed from a back surface by the primary transfer roller 5, and abuts on the photosensitive drum 1. Consequently, a primary transfer nip (a primary transfer unit) is formed between the photosensitive drum 1 and the intermediate transfer belt 17. A secondary transfer roller 12 is arranged at a position facing the secondary transfer counter roller 11, and a secondary transfer nip (a secondary transfer unit) is formed between the intermediate transfer belt 17 and the secondary transfer roller 12. The intermediate transfer belt 17 is rotated in an arrow direction by rotation of the secondary transfer counter roller 11, which also functions as a driving roller. Rotational speed of the intermediate transfer belt 17 is set at approximately same as the rotational speed (process speed) of the photosensitive drum 1.

The toner image formed by the development unit 4 on the photosensitive drum 1 is transferred to the intermediate transfer belt 17 at the primary transfer unit by superimposing toner images of the respective colors on the respective development units. The toner image transferred to the intermediate transfer belt 17 is transferred at the secondary transfer unit to the recording material S conveyed from a cassette (not shown) and synchronized in timing by a resist roller 13 with the toner image conveyed on the intermediate transfer belt 17. By heating and pressing the recording material S with the toner image transferred at the fixing unit 16, the toner image is fixed, and the recording material S is discharged outside. Residual toners on the photosensitive drum 1 after the primary transfer are removed by the drum cleaner 6, and the residual toners on the intermediate transfer belt 17 after the secondary transfer are removed by the belt cleaner 10.

Figure 2:
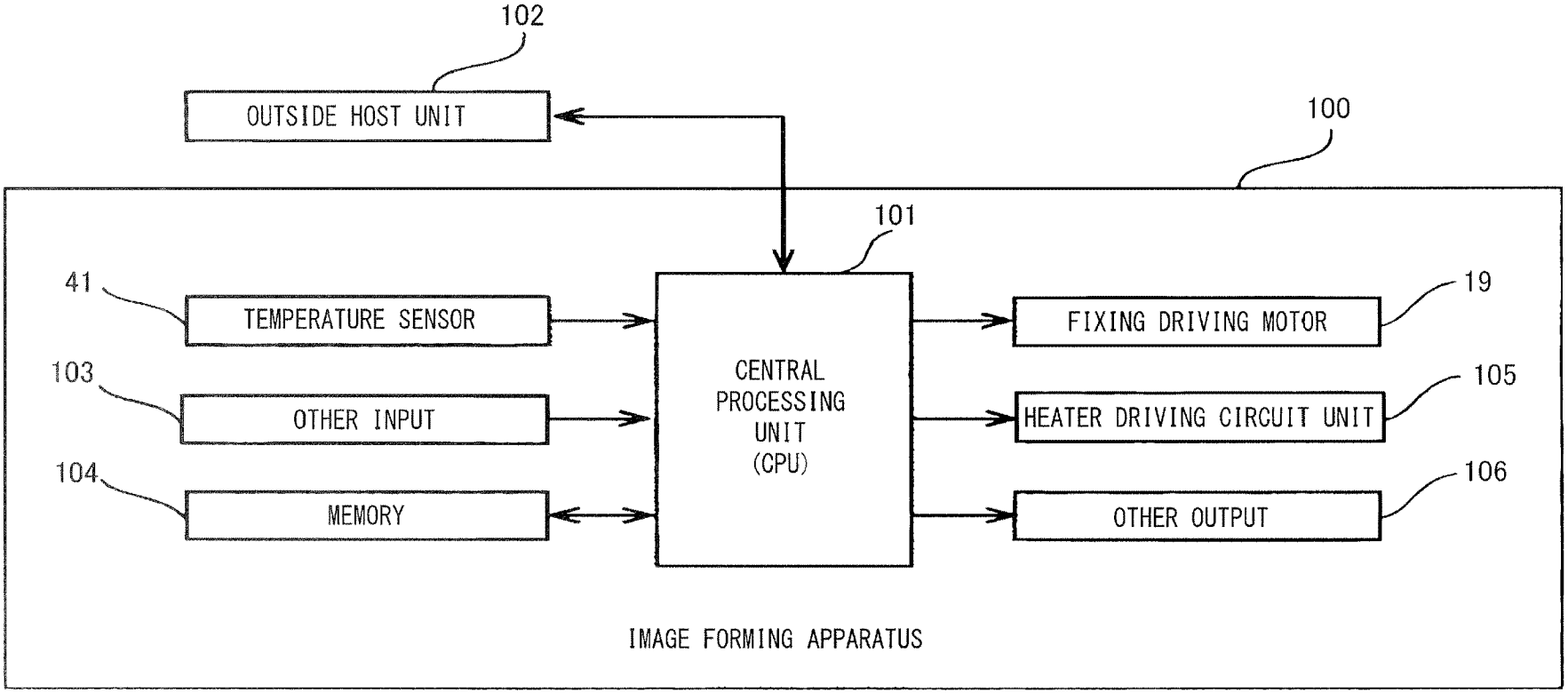
FIG. 2 is a control block diagram of the image forming apparatus according to the first embodiment.

The image forming apparatus as described above has a control circuit 101 such as a central processing unit (CPU), serving as a control unit, as illustrated in FIG. 2. The CPU 101 is coupled to an outside host unit 102 in a transmissible manner, and, in accordance with an input image information from the outside host unit 102, the CPU 101 controls each of various units as described above, and outputs by forming a full color image on the recording material S. Such as a computer and an image reader are the outside host unit 102.

The CPU 101 receives input signals from a temperature sensor 41, described later, in the fixing unit 16 and the other input 103 such as an environmental sensor arranged in an apparatus body and a detection sensor of the recording material. Also, the CPU 101 controls each of the various units based on various data such as programs stored in a memory 104. The memory 104 is, for example, such as a random-access memory (RAM) and a read only memory (ROM). Control objectives of the CPU 101 are the whole of the image forming apparatus 100. The CPU 101 controls, based on input signals from sensors and programs as described above, such as a fixing driving motor 19, which drives the fixing unit 16, a heater driving circuit unit 105 of the heating heater 39 of the fixing unit 16, and the other output 106 to other constituting members than the fixing unit 16. That is, the CPU 101 sends and receives signals to and from various image forming equipment and administers a sequence of image formation.

Fixing Unit

Figure 6:
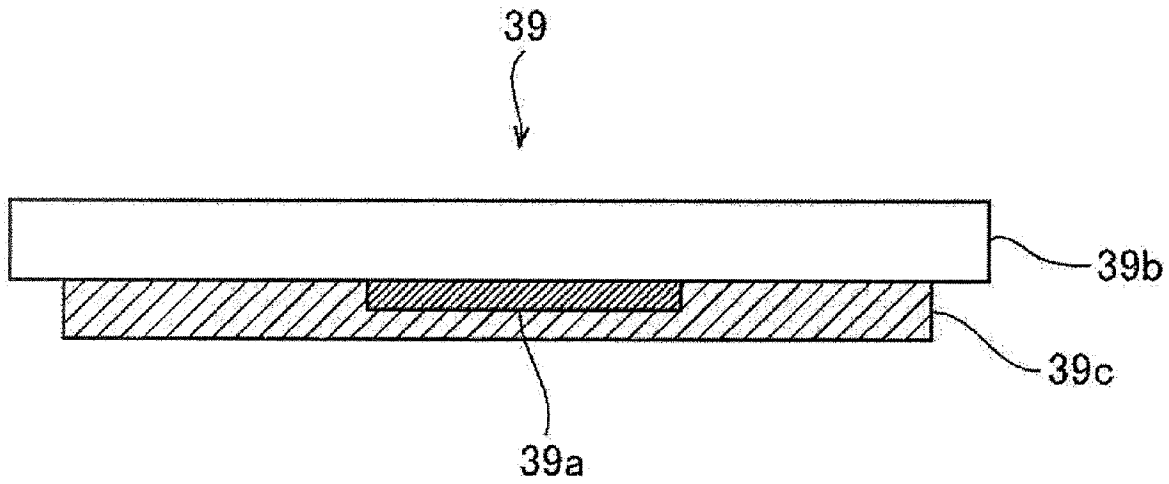
FIG. 6 is a schematic cross-sectional configuration diagram of a heating heater.

Next, the fixing unit 16 of this embodiment will be described using FIGS. 3 and 6.

Figure 3:
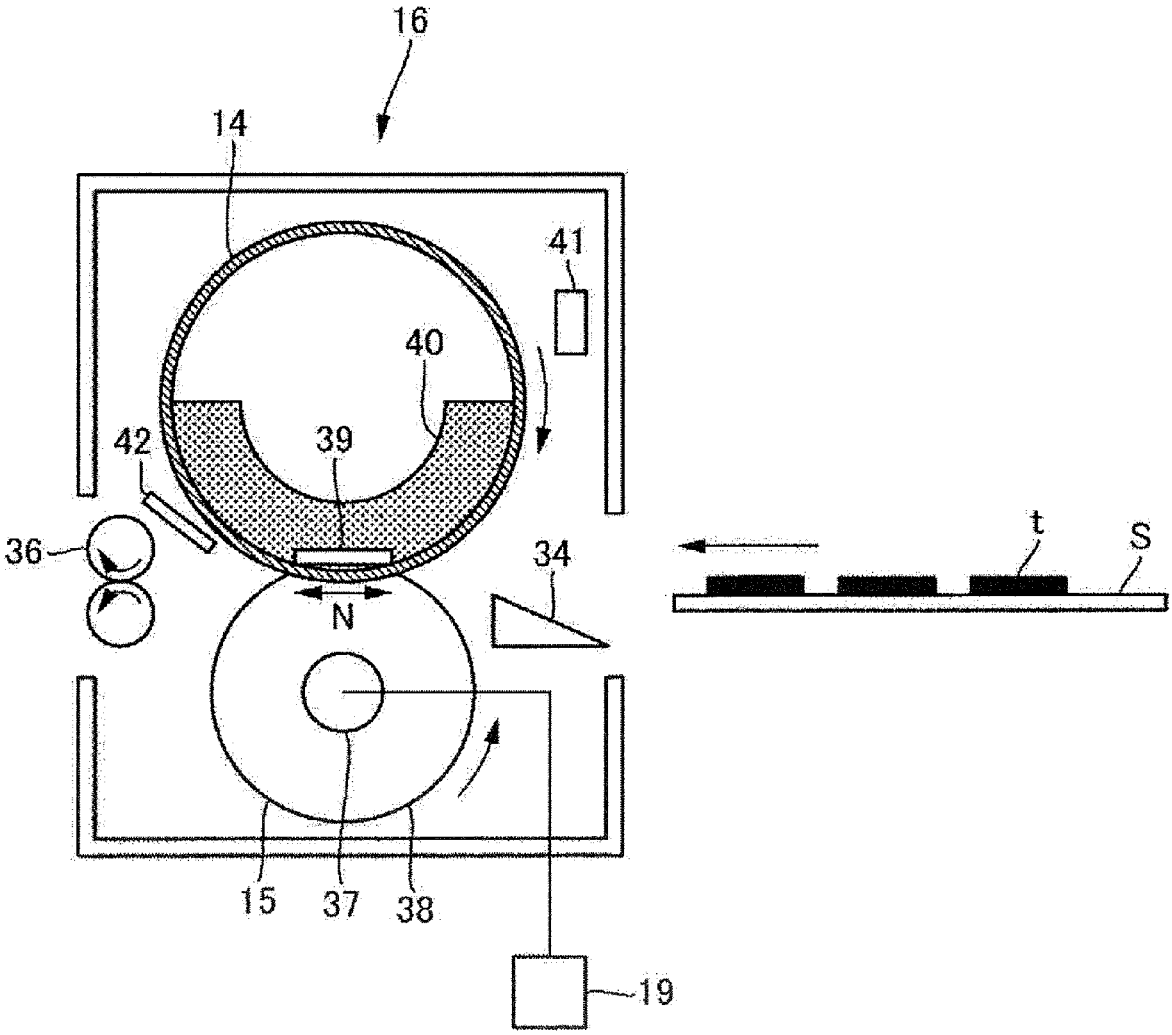
FIG. 3 is a schematic cross-sectional configuration diagram of a fixing unit according to the first embodiment.

The fixing unit 16 includes, as illustrated in FIG. 3, the fixing belt 14 of a rotating endless belt and the pressing roller 15 as a rotary member which rotates with forming a nip portion N with the fixing belt 14. The fixing belt 14 is formed in a film form and the heating heater 39 is arranged inside as a heating member to heat the fixing belt 14. The heating heater 39 is fixed at an underside of a heater holder 40 (side of the pressing roller 15) along a longitudinal direction of the fixing belt 14 (in direction of a front surface to a back surface of FIG. 3), and an inner circumferential surface of the fixing belt 14 and a heating surface of the heating heater 39 are able to slide on each other.

The heater holder 40 is made of a high heat-resistant liquid crystal polymer resin. The heater holder 40 holds the heating heater 39, and also functions as a guide for the fixing belt 14. In this embodiment, Zenite 7755 (trade name) produced by DuPont de Nemours, Inc. is used as the liquid crystal polymer resin.

Both ends of the heater holder 40 are urged by a pressing mechanism (not shown) toward an axis direction of the pressing roller 15 with a force of, for example, 156.8 N (16 kgf) for one end and 313.6 N (32 kgf) in total. As a result, an underside (heating surface side) of the heating heater 39 is in pressure contact by a predetermined pressing force with an elastic layer of the pressing roller 15 via the fixing belt 14, and the nip portion N having a required predetermined width for a fixing processing is formed. The pressing roller 15 is drivingly rotated by the fixing driving motor 19 of a driving unit and the fixing belt 14 is drivingly rotated by the pressing roller 15. Thus, the recording material S having born the toner image at the nip portion N is conveyed in a sandwiched manner.

In proximity of the circumference of the fixing belt 14, the temperature sensor 41 is arranged as a belt temperature detection unit for detecting a surface temperature of the fixing belt 14. At an upstream side of the nip portion N in a conveyance direction, a guide 34 is arranged to guide the recording material S to the nip portion N. The recording material S guided by the guide 34 and passed the nip portion N is separated from the fixing belt 14 by a separation guide 42. The separation guide 42 is arranged as a separation unit at a downstream side of the nip portion N in the conveyance direction in the circumference of the fixing belt 14 and facing the nip portion N. The recording material S separated from the fixing belt 14 is discharged outside the fixing unit 16 by a pair of sheet discharge rollers 36. Each configuration will be described in more detail below.

Fixing Belt

Figure 4:
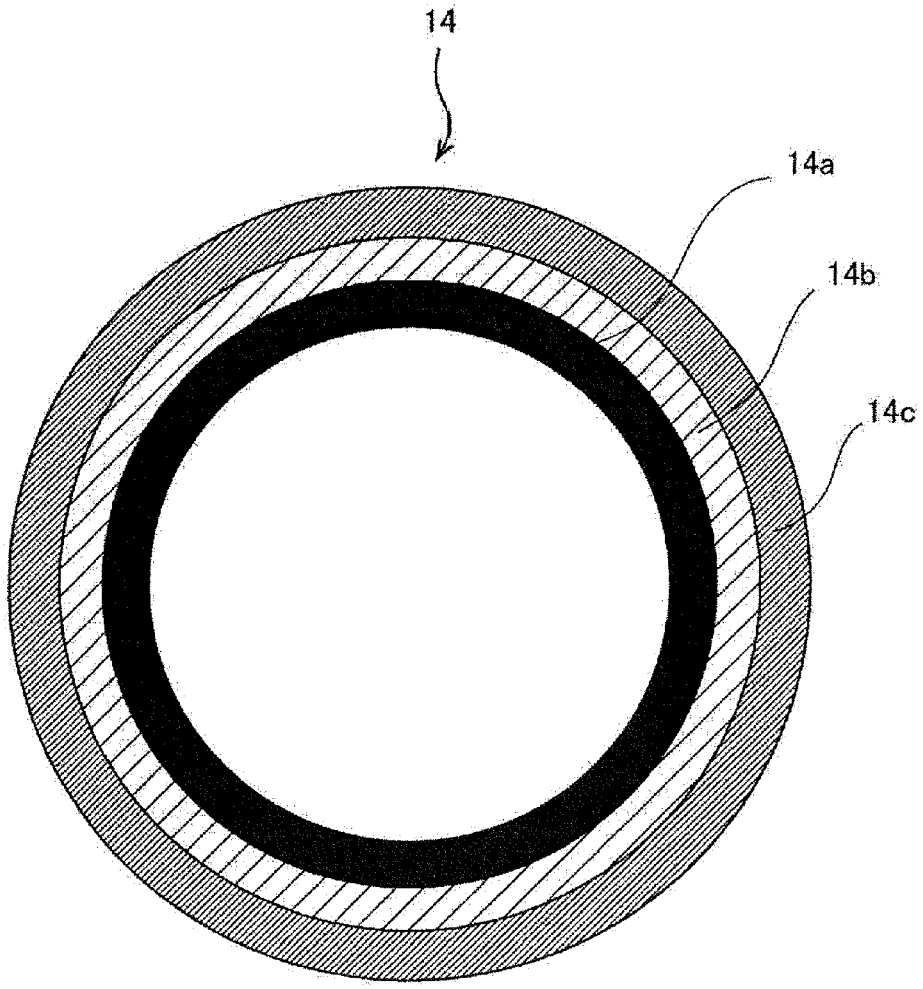
FIG. 4 is a schematic cross-sectional diagram of a fixing belt.

The fixing belt 14 is, as illustrated in FIG. 4, composed of a base layer 14*a*, an elastic layer 14*b* formed on the base layer, and a releasing layer 14*c* formed on the elastic layer. The base layer 14*a* is made of a heat-resistant resin such as polyimide, polyamidimide, and polyetheretherketone (PEEK), or a pure metal such as stainless steel (SUS), Al, Ni, Cu, and Zn or an alloy having a heat-resistant and high thermal conductivity characteristics. In a case where the base layer is made of a resin, a powder of high thermal conductivity such as boron nitride (BN), alumina, and Al may be mixed to improve thermal conductivity. And, a total thickness of equal to or greater than 20 μM is necessary to obtain the fixing belt 14 of an adequate strength and durability required to compose an elongated life fixing unit. In this embodiment, the base layer 14*a* is, for example, 50 μM thickness and made of a heat-resistant polyimide resin.

The elastic layer 14*b* is made of the heat-resistant material using a synthetic rubber as a main component. As the synthetic rubber, such as a silicone rubber, a fluororubber, and a fluorosilicone rubber are preferably used. In this embodiment, the elastic layer 14*b* is, for example, 180 μm thickness and made of the heat-resistant silicone rubber.

On a surface layer of the fixing belt 14, the releasing layer 14*c* is formed by coating with one of or a mixture of a fluorocarbon resin, a silicone resin, and the like of a good releasing and heat-resistant characteristics such as poly tetrafluoroethylene (PTFE), a tetrafluoroethylene perfluoroalkylvinylether copolymer (PFA), a tetrafluoroethylene hexafuluoropropylene copolymer (FEP), an ethylene tetrafluoroethylene copolymer (ETFE), polychlorotrifluoroethylene (CTFE), and polyvinylidene fluoride (PVDF). This releasing layer 14*c* is provided to prevent an offset which moves toners on a recording material toward the fixing belt 14, and is provided to secure a separability of the recording material from the fixing belt 14. In this embodiment, the releasing layer 14*c* is made of heat-resistant materials which includes at least one of PTFE and PFA, and is, for example, composed of a 30 μm thickness PFA tube overlaid over the elastic layer 14*b*.

Regarding a coating method, the releasing layer may be coated by dipping or powder spray after an etching processing of a circumference of the elastic layer 14*b*. Or, a method of overlaying a tube-shaped resin over the elastic layer is acceptable. Or, after blasting the circumference of the elastic layer 14*b*, a method of applying a primer layer with an adhesive and then coating the releasing layer is also acceptable.

Figure 5:
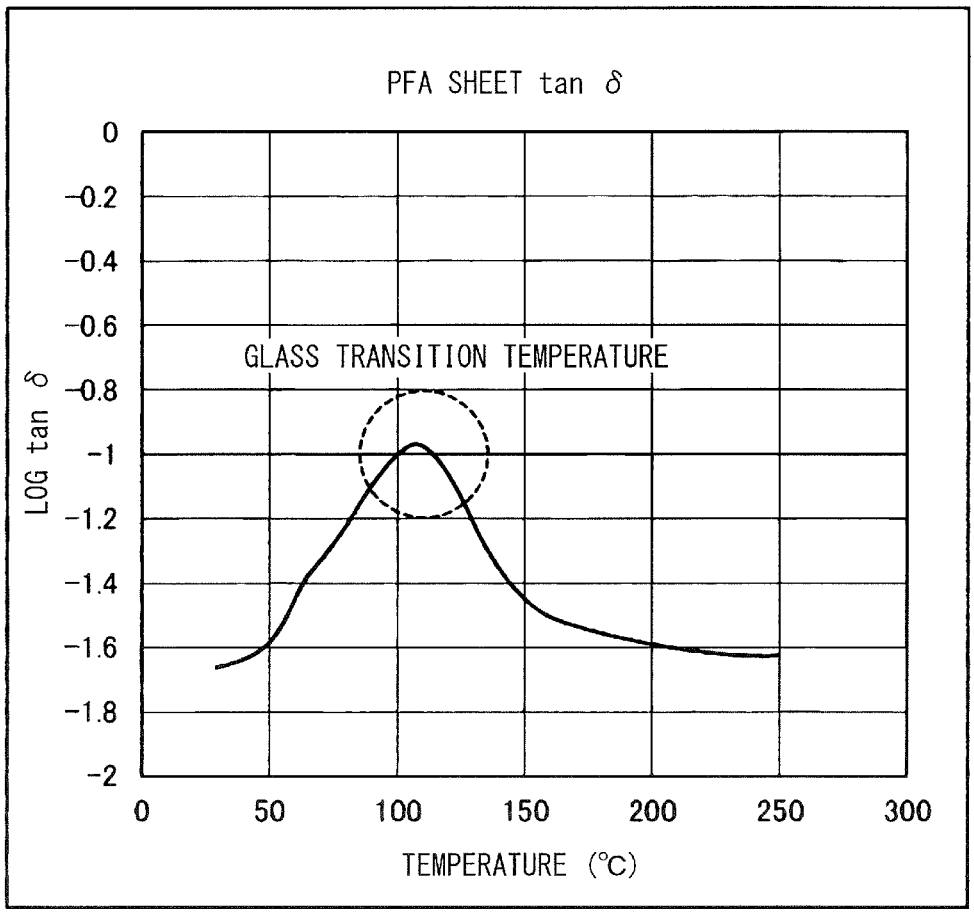
FIG. 5 is a diagram showing a temperature characteristic of loss tangent tan δ of a PFA sheet.

To be noted, in this embodiment, trade name: 451HP-J produced by Mitsui-DuPont Furorokemikaru Kabusiki Kaisha is used for PFA. FIG. 5 shows a temperature characteristic of loss tangent tan δ (loss modulus/storage modulus) of 451HP-J (PFA). It is possible to evaluate a glass transition temperature Tg from a peak temperature of tan δ, and it is shown that the peak temperature is approximately 110° C. in the case of 451HP-J (PFA). That is, the glass transition temperature Tg of the fixing belt 14 in this embodiment is 110° C. A viscoelasticity measurement apparatus (trade name: Rheogel-E4000, produced by UBM) was used for a measurement of the loss tangent. This apparatus is a forced vibration non-resonance method vertical dynamic viscoelasticity measurement apparatus, and measures a distortion response by a crystal piezoelectric stress detector by providing a sample with sine wave distortion. An amplitude at each frequency and a difference of a phase angle are derived by a fast Fourier transform (FFT) operation based on a dynamic stress wave form and dynamic displacement wave form, and it is possible to calculate the loss modulus, the storage modulus, the loss tangent, etc.

Pressing Roller

The pressing roller 15 is, as illustrated in FIG. 3, an elastic roller composed of a core metal 37 and an elastic layer 38 on a circumference of the core metal 37. The core metal 37 is made of a metal such as SUS, sulfurized and sulfur composite free-cutting steel (SUM), and Al, and the elastic layer 38 is made of an elastic solid rubber layer, an elastic sponge rubber layer, an elastic porous rubber, or the like. In this description, the elastic solid rubber layer is made of a heat-resistant rubber such as the silicone rubber and the fluororubber. Also, the elastic sponge rubber layer is formed by foaming the silicone rubber to increase heat insulation effect. And the elastic porous rubber layer is formed by dispersing a hollow filler (micro balloon and the like) in the silicone rubber layer, and is increased in the heat insulation effect by providing a hardened material with a gas portion. On this elastic layer 38, a layer of PFA, PTFE and the like having a releasing characteristic may be formed. In this embodiment, an outside diameter of the pressing roller 15 is 25 mm Heating Heater In the heating heater 39, a normal heating resistant layer 39*a* is, as illustrated in FIG. 6, formed on a surface of an insulating ceramic substrate 39*b* along a longitudinal direction. And the normal heating resistant layer 39*a* is protected by a protection layer 39*c*. The insulating ceramic substrate 39*b* is made of a plate-shaped insulating ceramic of a low heat capacity such as alumina and aluminum nitride. The insulating ceramic substrate 39*b* used in this embodiment is, for example, 10 mm in width in a conveyance direction of the recording material. The normal heating resistant layer 39*a* is formed by a screen printing of a resistor such as silver-palladium (Ag/Pd), ruthenium oxide (RuO), and tantalum nitride ($Ta_2N$) on a surface of the insulating ceramic substrate 39*b*. The normal heating resistant layer is, for example, formed 10 μm thickness. In the above description, the longitudinal direction is the direction intersecting with the conveyance direction of the recording material, and is an axial direction of the pressing roller 15, and also is a longitudinal direction of the fixing nip portion N. The protection layer 39*c* is provided on a surface of the heating heater 39 abutting on the fixing belt 14 to protect the normal heating resistant layer 39*a* to an extent not harming a thermal efficiency. For the protection layer 39*c*, preferred characteristics are adequately thin in thickness and improved surface properties, and a glass or fluororesin coating, or the like is provided.

Driving of Fixing Unit

The pressing roller 15 gains a driving force to rotate in an arrow direction of FIG. 3 from the fixing driving motor 19 coupled to the edge of the core metal 37. The fixing driving motor 19 is controlled by command from the CPU 101. Along with the rotary drive of the pressing roller 15, the fixing belt 14 is drivingly rotated (moved) by a force of friction with the pressing roller 15. At this time, the fixing belt 14 slides against the heating heater 39. By interposing a lubricant such as a fluoro-based and silicone-based heat-resistant grease between the fixing belt 14 and the heating heater 39, a friction resistance is lessened, and the fixing belt 14 becomes smoothly rotatable (movable). The temperature control of the heating heater 39 is performed based on a signal of a temperature detection element, such as a thermistor, provided on a back surface of the ceramic substrate. That is, the CPU 101 keeps an inside temperature of the nip portion N at an intended predetermined fixing processing temperature by determining and appropriately controlling a duty ratio, a frequency, and the like of a voltage applied to the normal heating resistant layer 39*a* based on the signal of the temperature detection signal element. To be noted, a rotational speed of the pressing roller 15 is 150 mm/s in this embodiment.

Since the fixing unit 16 which uses the fixing belt 14 as described above is thin in thickness, small in heat capacity, and also good in a thermal response characteristic, it is possible to directly reflect the thermal response of the heating heater 39 on an inside of the nip portion N almost without delay. Accordingly, the fixing temperature is enabled to reach at the predetermined temperature in a short period of time after turning on a heater (on-demand system), and an electric power saving is realized accordingly.

In this embodiment, a tensionless system is applied and the fixing belt 14 of a cylinder shape is driven by a moving force of the pressing roller 15. This simplifies a configuration of apparatus, and a fixing unit achieves a low cost. However, the fixing unit of this sort of the tensionless system is liable to get a kink to flap due to the fixing belt 14 being left above the glass transition temperature, as described above. Especially, the flap of the fixing belt 14 becomes larger when the fixing belt 14 is drivingly rotated in conditions of being with the kink and not warmed-up above the glass transition temperature.

Figure 7:
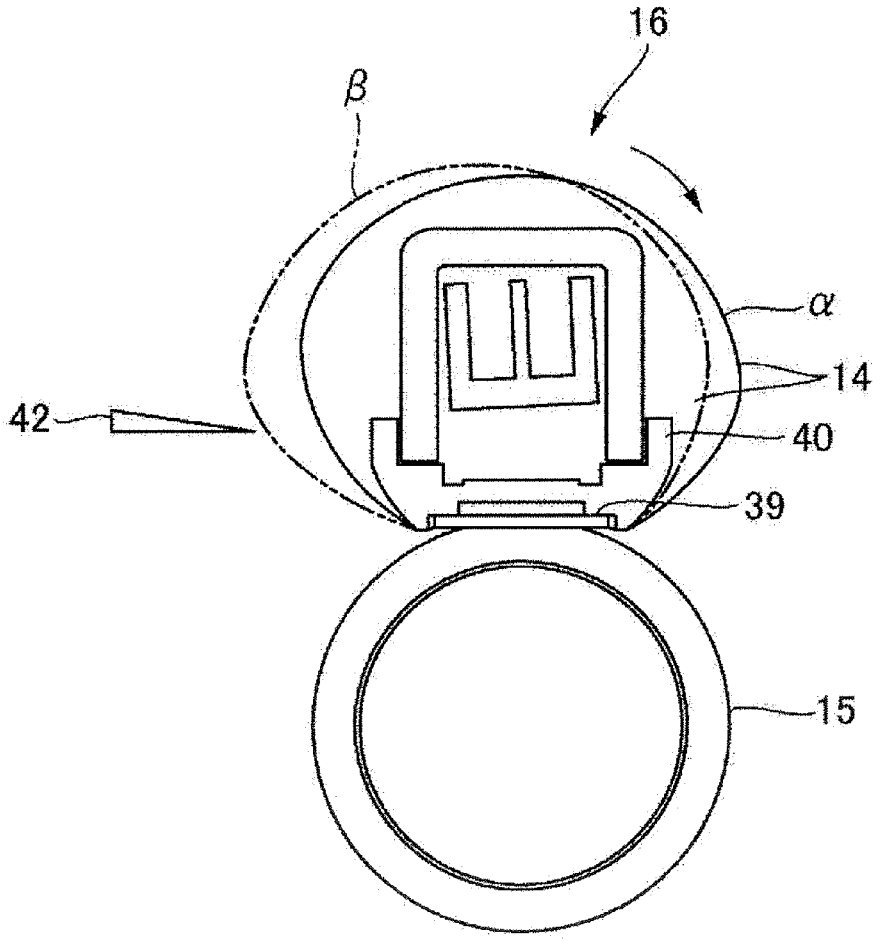
FIG. 7 is a schematic cross-sectional diagram of the fixing unit showing a track of the fixing belt in a state of flapping.

That is, as illustrated in FIG. 7, when the fixing belt 14 is rotated in a condition of either being heated above the glass transition temperature or not being heated above the glass transition temperature but without the kink, the fixing belt 14 follows a track shown by a solid line α. On the other hand, when the fixing belt is rotated in a condition of being with the kink and not warmed-up above the glass transition temperature, the fixing belt 14 follows a partially swollen track shown by a two-dot chain line β. Because the fixing belt 14 stops at above the glass transition temperature and is left to be cooled below the glass transition temperature, the fixing belt 14 copies a shape of the nip portion N and gets the kink. Accordingly, when the fixing belt 14 with the kink is rotated in an arrow direction in FIG. 7, which is a rotational direction at a normal fixing processing of an image (fixing processing), the fixing belt 14 swells toward a downstream side of the nip portion N.

Since the separation guide 42 is arranged facing the fixing belt 14 and at the downstream side of the nip portion N, there is a possibility that the fixing belt 14 contacts with the separation guide 42 and a surface of the fixing belt 14 is damaged. When the surface of the fixing belt 14 is damaged, a mark of damage appears on an image side of the recording material, and degrades an image quality. Accordingly, in this embodiment, a following processing described below is performed at a stop of the rotation of the fixing belt 14 along with the end of the fixing processing (at the end of a job).

Control at the End of the Job

Figure 8:
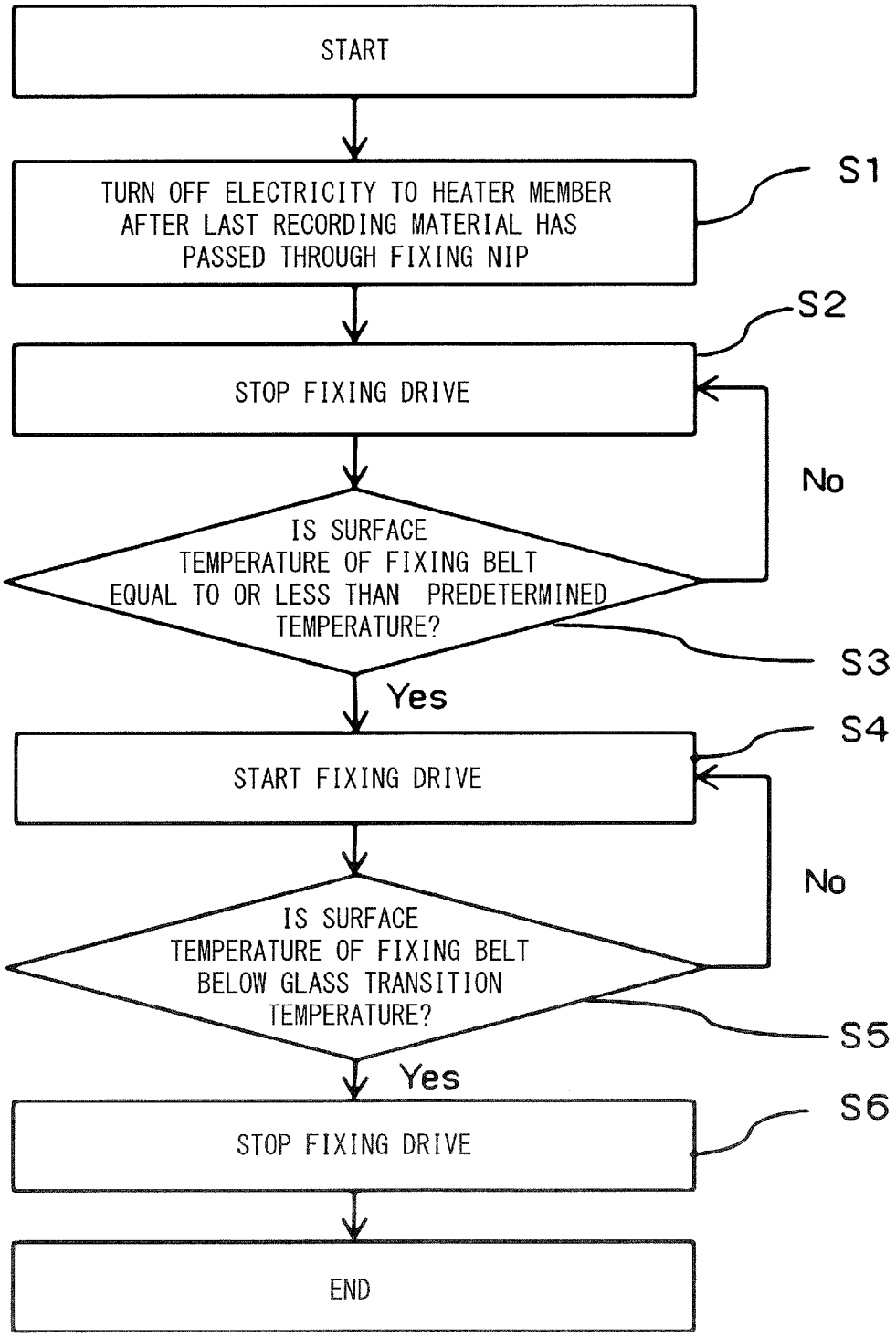
FIG. 8 is a flow chart showing processing of the fixing unit at the end of a job according to the first embodiment.

Next, a control of the fixing unit 16 at the end of the job will be described with reference to FIGS. 8 and 9. To be noted, the job is image forming processing based on a command given by users and the like, and, for example, in the case of the command to perform 10 sheets of image formation, the job is the processing to perform 10 sheets of the image formation including the fixing processing.

First, when the image formation has ended and the last sheet of the recording material of the job has passed the nip portion N (the fixing processing has ended), the CPU 101 turns off an electricity to the heating heater 39 from a heater driving circuit unit 105 (S1). In addition, to stop the rotation of the fixing belt 14, the fixing driving motor 19 is stopped (S2). And, when a detected temperature of the temperature sensor 41 detecting a surface temperature of the fixing belt 14 becomes a predetermined temperature Tg+A (125° C. in this embodiment, described later) which is near the glass transition temperature of the releasing layer 14*c* of the fixing belt 14 (approximately 110° C. in this embodiment) (S3), the CPU 101 resumes the rotation of the fixing belt 14 (S4). That is, the fixing driving motor 19 is driven. When the detected temperature of the temperature sensor 41 falls below the glass transition temperature described above (S5), the CPU 101 stops the rotation of the fixing belt 14 (S6). That is, a drive of the fixing driving motor 19 is stopped.

Figure 9:
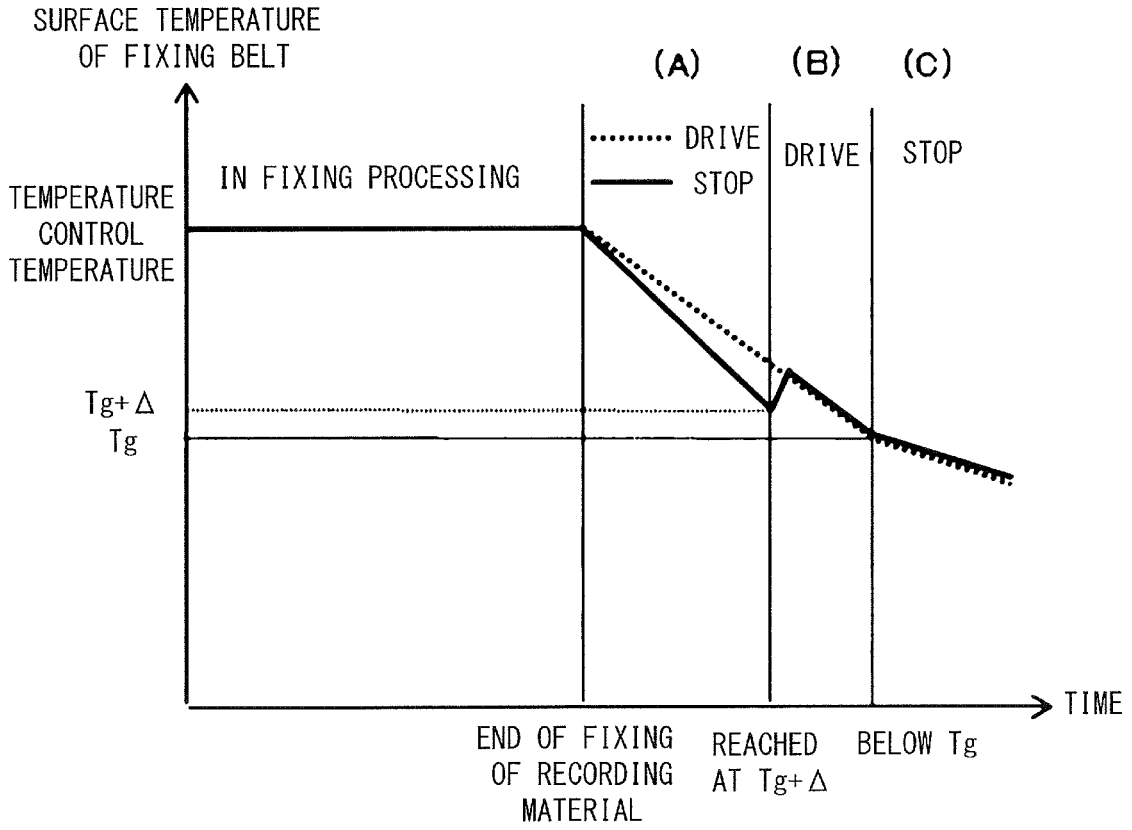
FIG. 9 is a schematic diagram showing a change in a surface temperature of the fixing belt in course of time according to the first embodiment.

As illustrated in FIG. 9, during the job (fixing processing), a temperature control temperature of the fixing belt 14 (that is, a target temperature of the fixing belt 14 during the fixing processing) is higher than the glass transition temperature Tg thereof. Next, in an area after the end of the job indicated by an area (A), the surface temperature of the fixing belt 14 continues to be higher than the glass transition temperature Tg of the fixing belt 14 for a period of time. In this embodiment, the fixing belt 14 is stopped at this time. And, when the surface temperature of the fixing belt 14 reaches at a predetermined temperature Tg+Δ near the glass transition temperature Tg of the fixing belt 14, shifting to an area (B), the fixing belt 14 is started the rotation. To be noted, duration of driving time shown in FIG. 9 differs depending on the temperature control temperature of the fixing belt, a number of passing sheets of the recording material, an operational environment of the apparatus, and the like.

Figure 10A:
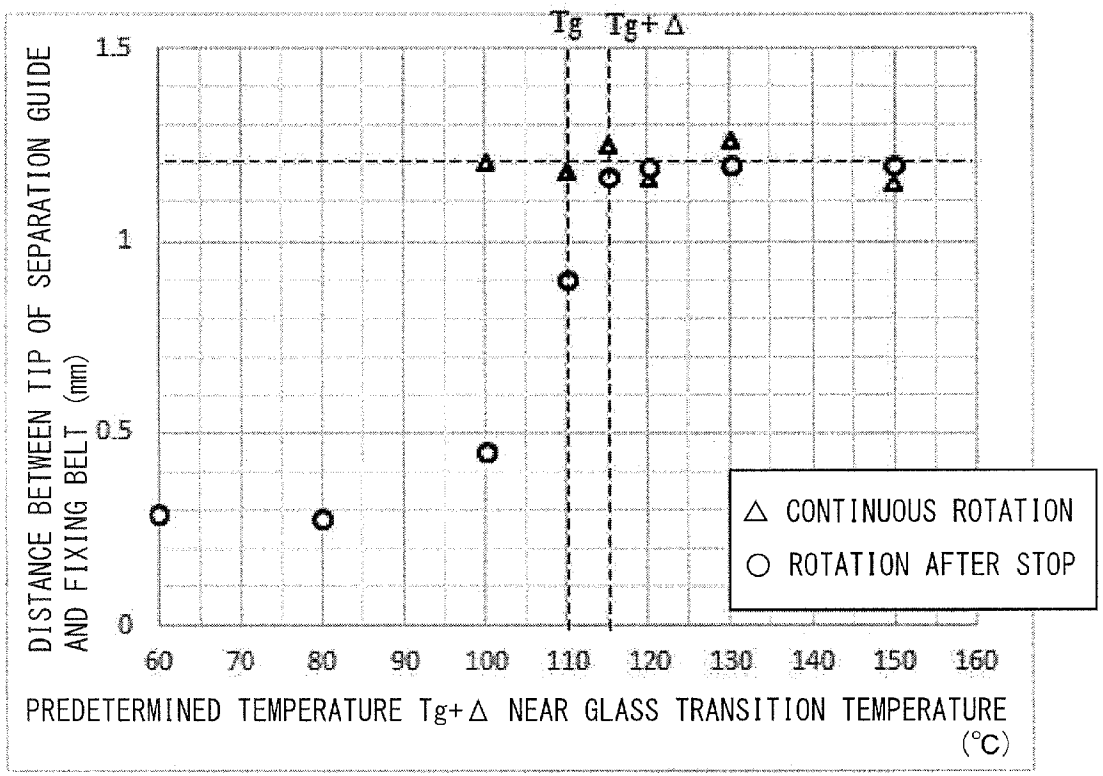
FIG. 10A is a diagram showing a correlation between a glass transition temperature and the deformation amount of the fixing belt according to the first embodiment.
Figure 10B:
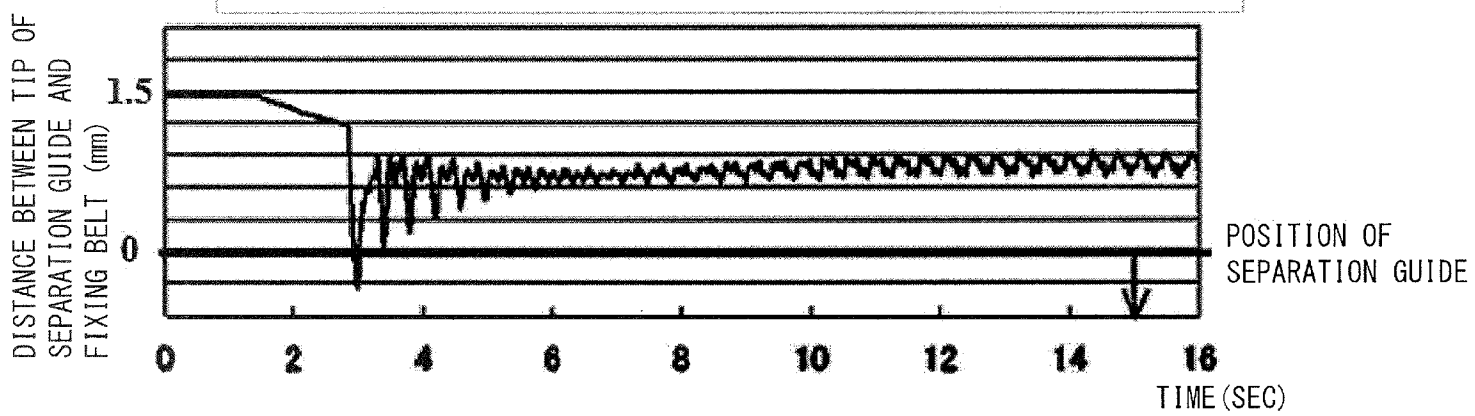
FIG. 10B is a diagram showing a change in a distance between a separation guide and the fixing belt in course of time.

FIG. 10A shows a correlation of the predetermined temperature Tg+A near the glass transition temperature Tg of the fixing belt 14 with the deforming amount of the fixing belt 14 when the predetermined temperature Tg+A is changed. Specifically, after the end of the job, the rotation of the fixing belt 14 is stopped, and the above described control is performed at different detected temperatures of the temperature sensor 41. A degree of the deforming amount is evaluated by measuring the distance between the separation guide 42 and the fixing belt 14 by starting a rotational movement of the fixing belt 14 after adequately cooled the fixing belt 14. It is noted that an initial distance between the separation guide 42 and the fixing belt 14 is set at 1.5 mm Changes in distance between the separation guide 42 and the fixing belt 14 due to flapping are shown in FIG. 10B in course of time, and a largest amplitude is used as a value of the distance.

As shown in FIG. 10A, by comparing with plots of the case where the deforming amount of the fixing belt 14 is minimized by continuously rotating the fixing belt 14 after the end of the job, for a configuration of this embodiment, where rotation after a stop is performed, 115° C. is considered reasonable for Tg+Δ as a condition to obtain a similar plot of the deforming amount, but 125° C. is considered preferable by taking into account a variance (Tg=110° C., Δ=15° C.). Accordingly, Tg+Δ in this embodiment is 125° C.

Although the glass transition temperature Tg of the fixing belt 14, which determines an ending condition for the control, is 110° C. in the configuration of this embodiment, the fixing belt 14 is continued rotation until 90° C. by a similar reason.

Effect

By the control in accordance with the flow scheme as described above, in the case of the fixing belt 14 being cooled from a temperature equal to or higher than the glass transition temperature Tg of the fixing belt 14 to a temperature equal to or lower than the glass transition temperature Tg of the fixing belt 14 after the end of the job, the fixing belt 14 is enabled to follow a similar track as shown by the solid line α in FIG. 7, and is enabled to prevent flapping, and also is enabled to avoid contact with the separation guide 42.

And, as shown in FIG. 9, a running time of the fixing belt 14 is substantially decreased as compared with the case of a control to maintain the continuous rotation after the end of the job.

For example, when a job of 5 sheets each is repeatedly tested at a productivity of 30 ppm, required time for one job is indicated in a table below. Areas (A) to (C) in the table correspond to respective areas in FIG. 9.

TABLE 1

| REQUIRED TIME FOR PROCESSING | | | |
|---|---|---|---|
| | | CONTINUOUS ROTATION | THIS EMBODIMENT |
| CONTROL IN JOB | START UP | 10 | 10 |
| | PASSING SHEETS | 10 | 10 |
| CONTROL SUBSEQUENT TO JOB | AREA (A) | 15 | 0 |
| | AREA (B) | 5 | 5 |
| | AREA (C) | 5 | 5 |
| TOTAL REQUIRED TIME | | 45 | 30 |

UNIT: sec.

In the case of the control to maintain the continuous rotation, the running time is 1.5 times of the running time in the case of the control of this embodiment. And, the required time in the table described above is an estimate in the case where the fixing unit 16 is not adequately warmed-up, and along with a repeat of the job the fixing unit 16 is warmed-up and becomes to be hardly cooled after the job. Under such conditions, the required time for a control of the area (A), which is the area subsequent to the end of the job, increases, and superiority of the control of this embodiment in minimizing the running time as much as possible is expanded.

The above has described the control which stops the rotation of the fixing belt 14 after the end of the job, resumes the rotation in timing of the fixing belt being cooled to near the glass transition temperature of the fixing belt 14, and stops the rotation after cooled below the glass transition temperature of the fixing belt 14. Accordingly, it is possible to reduce the flap of the fixing belt 14 due to the kink, possible to avoid the contact of the separation guide 42 with the fixing belt 14, and also possible to attain the life elongation of the fixing belt 14 by limiting an increase in running distance of the fixing belt 14.

To be noted, numbers used in this embodiment are those of an example, and are not uniquely determined by a configuration of the fixing unit or the like.

Although the temperature sensor 41 is used in this embodiment to detect the front surface temperature of the fixing belt 14 as the temperature detection unit to detect the temperature of an endless belt on the front surface, for example, one of or a combination of the temperature detection unit to detect the temperature of an endless belt on the front surface, the temperature sensors detecting an inside temperature of the fixing belt 14 as the temperature detecting unit to detect the temperature of the endless belt on the back surface, the temperature sensor detecting the temperature of the heating heater 39 as the temperature detection unit to detect the temperature of the heating unit, and the temperature sensor detecting the surface temperature of the pressing roller 15 as the temperature detection unit to detect the surface temperature of the rotary member may be provided and may perform as a unit to indirectly calculate the surface temperature of the fixing belt 14. That is, either configuration of directly or indirectly detecting the temperature of the endless belt is acceptable as long as the configuration is capable of detecting the temperature of the endless belt (the fixing belt 14 in this embodiment).

Second Embodiment

In the first embodiment described above, the embodiment where the rotation of the fixing belt 14 at the end of the job is controlled by detecting the surface temperature of the fixing belt 14 has been described.

On the contrary, in a second embodiment, the rotation of the fixing belt 14 is controlled not by temperature detection information but by a time count by a timer.

As other configurations and functions are similar to those of the first embodiment, description will be omitted or simplified by giving the same marks on duplicating configurations, and different aspects from the first embodiment will be described below.

Warming-Up of Fixing Unit

A warming-up degree of the fixing unit 16 is determined by a temperature of a fixing temperature control at an execution of the job and duration of time for the job (number of passing sheets). Along with the warming-up degree of the fixing unit, required time for cooling the fixing belt 14 after the end of the job is extended.

Figure 11:
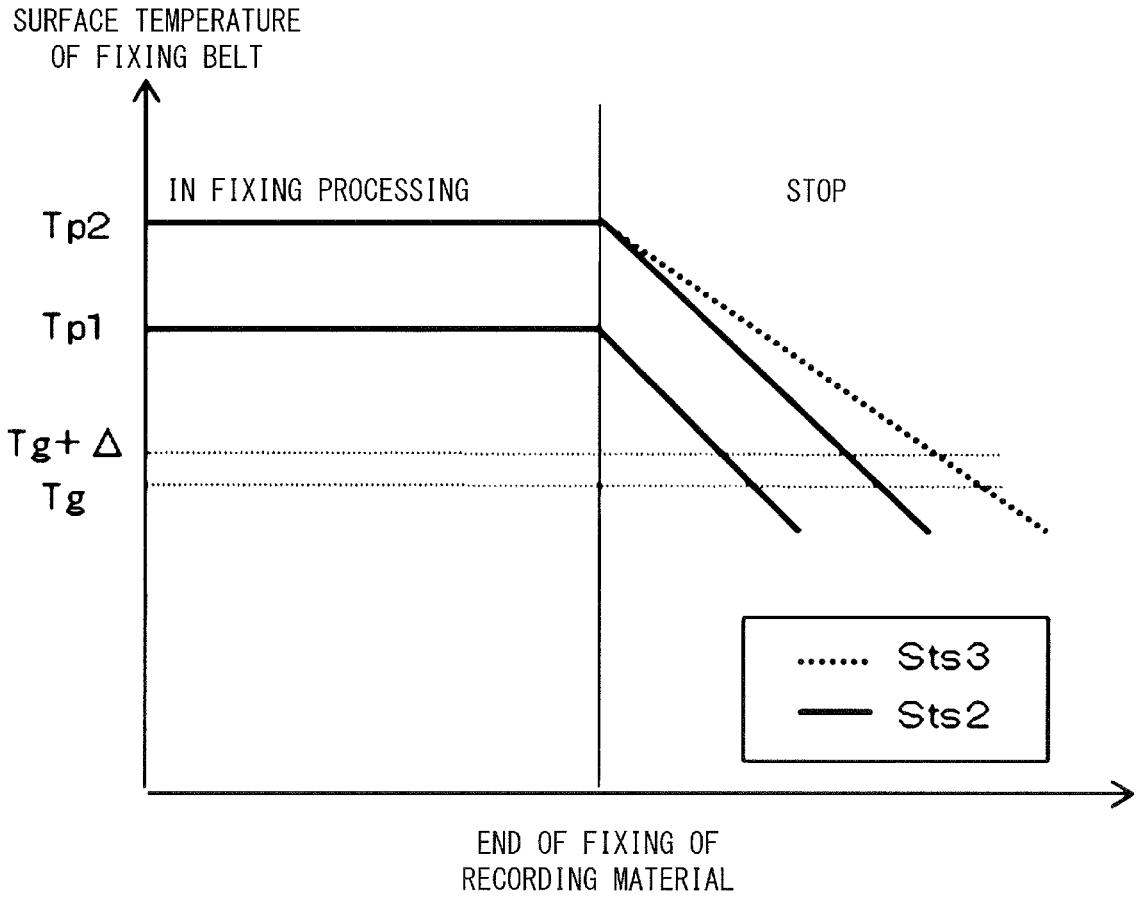
FIG. 11 is a schematic diagram showing a change in the surface temperature of the fixing belt in course of time according to a second embodiment.

FIG. 11 shows a change in a temperature of the fixing belt 14 in a course of time when 2 jobs different in the temperature control temperature Tp are executed. Furthermore, a solid line shows the change in the temperature in the case of a temperature Sts 2, and a dotted line shows the change in the temperature in the case of a temperature Sts 3.

The temperature Sts described above is represented by a level determined corresponding to the number of passing sheets through the fixing unit 16 in a sheet passing job and the like. Larger Sts number indicates higher degree of the warming-up of the fixing unit 16. In this embodiment, the temperature Sts is defined as listed in a table below.

TABLE 2

| TEMPERATURE Sts | EQUIVALENT TO A4 LENGTH: NUMBER OF SHEETS |
|---|---|
| TEMPERATURE Sts1 | 0~10 |
| TEMPERATURE Sts2 | 10~50 |
| TEMPERATURE Sts3 | 50~300 |
| TEMPERATURE Sts4 | 300~ |

UNIT: number of sheet

Setting of the temperature control temperature Tp at the fixing unit 16 of this embodiment is allowed to vary between 130° C. and 190° C. in accordance with differences in paper types. When dT is defined as a temperature difference between the temperature control temperature Tp and the glass transition temperature Tg of the fixing belt 14 (110° C. in the present invention), required time for the fixing belt 14 to reach Tg+A after the end of the job can be calculated based on dT and the temperature Sts in combination. In a case of the fixing unit 16 of this embodiment, there are relations as shown in Table 3 below.

TABLE 3

REQUIRED TIME TO REACH Tg + Δ AFTER END OF JOB

| | | TEMPERATURE Sts | | | |
|---|---|---|---|---|---|
| | | Sts1 | Sts2 | Sts3 | Sts4 |
| dT | 20-35 | 5 | 7 | 10 | 15 |
| | 35-50 | 10 | 12 | 15 | 20 |
| | 50-65 | 15 | 17 | 20 | 25 |
| | 65-80 | 20 | 22 | 25 | 30 |

UNIT: sec.

Figure 12:
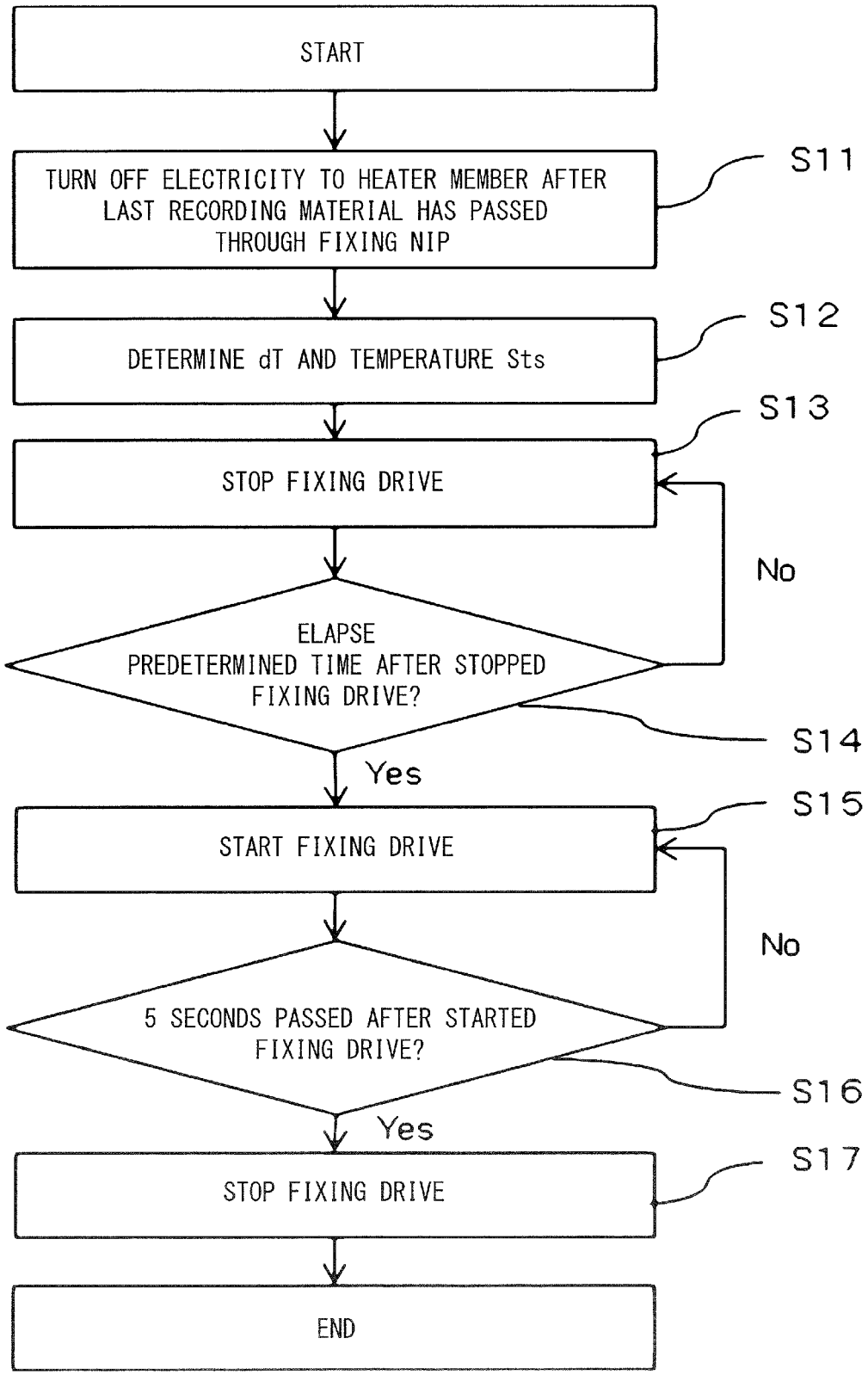
FIG. 12 is a flow chart showing processing of the fixing unit at the end of a job according to the second embodiment.

Next, a control of the fixing unit 16 at the end of the job in this embodiment will be described with reference to FIG. 12.

At first, when the image formation has been ended and the last recording material has passed the nip portion N (fixing processing has been ended), the CPU 101 turns off electricity from the heater driving circuit unit 105 to the heating heater 39 (S11). At that time, the CPU 101 determines dT and the temperature Sts described above, and stores corresponding required time found in Table 3 described above in the memory 104 (S12).

Also, the CPU 101 stops the fixing driving motor 19 (S13) to stop the rotation of the fixing belt 14.

Next, the CPU 101 counts time after a stop of the fixing driving motor 19, and maintains to stop until the time reaches the required time stored in the memory 104 (S14).

When the time has reached the required time described above, the CPU 101 resumes a rotational movement of the fixing belt 14 (S15). That is, the CPU 101 drives the fixing driving motor 19. The CPU 101 starts to count again, and when 5 seconds have passed after a start of the fixing driving motor 19 (S16), the CPU 101 stops the rotation of the fixing belt 14. That is, the CPU 101 stops the drive of the fixing driving motor 19 (S17).

To be noted, the required time shown in Table 3 changes depending on a configuration, an operating environment, and the like of the fixing unit.

The above has described the control which stops the rotation of the fixing belt 14 after the end of the job, restarts the rotation in timing of the fixing belt 14 being cooled to near the glass transition temperature of the fixing belt 14 based on the time count by the timer, and stops the rotation after cooled below the glass transition temperature of the fixing belt 14. By this control, it is possible to reduce the flap of the fixing belt 14 due to the kink, possible to avoid the contact of the separation guide 42 with the fixing belt 14, and also possible to attain the life elongation of the fixing belt 14 by limiting an increase in running distance of the fixing belt 14.

To be noted, numbers used in this embodiment are those of an example, and are not uniquely determined by a configuration of the fixing unit and the like.

Other Embodiments

In the embodiments described above, although a configuration of the heating heater arranged at a position corresponding to the nip portion N in the fixing belt 14 has been described, the present invention is applicable to the other configurations if such configurations use the endless belt of a film shape or the like. And, although the pressing roller is used as the rotary member, the present invention is applicable to configurations where the endless belt is composed as the rotary member.

And, although in the embodiments described above, the nip portion is formed by pressing the fixing belt 14 toward the pressing roller 15 of the rotary member, the present invention is applicable to the case of pressing in a reverse direction. That is, the present invention is applicable to a configuration where the rotary member is pressed toward the endless belt.

A configuration of the fixing belt is not limited to the tensionless configuration, and, for example, the fixing belt may be configured to include stretch rollers inside. Also, a configuration of a driving unit which rotates the fixing belt is not limited to a configuration of driving via the rotary member, and the fixing belt may be configured to drivingly rotate itself directly. For example, the fixing belt may be stretched with a plurality of rollers in which one of the rollers is configured to be a driving roller, and the fixing belt is drivingly rotated by transmitting the driving force from a motor to the driving roller described above. The point is, what needed for the driving unit are to drivingly rotate at least one of the endless belt and the rotary member and to enable the conveyance of the recording material through the nip portion in a sandwiched manner.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-065190, filed Mar. 29, 2019 which is hereby incorporated by reference herein in its entirety.

What is claimed is:

1. An image forming apparatus comprising:

a fixing unit comprising:

a rotating endless belt;

a rotary member configured to form a nip portion with the endless belt and rotate;

a heating member configured to heat the endless belt;

a driving unit configured to rotatably drive at least one of the endless belt and the rotary member to convey a recording material nipped at the nip portion; and a separation member arranged facing a circumference of the endless belt and configured to separate the recording material, after passing through the nip portion, from the endless belt; and a control unit configured to control the driving unit such that the endless belt stops along with an end of a fixing processing and rotates when a temperature of the endless belt passes a glass transition temperature of the endless belt from higher than the glass transition temperature of the endless belt to lower than the glass transition temperature of the endless belt.

2. The image forming apparatus according to claim 1, further comprising a temperature detection unit configured to detect a temperature on a front surface of the endless belt.

3. The image forming apparatus according to claim 1, further comprising a temperature detection unit configured to detect a temperature on a back surface of the endless belt.

4. The image forming apparatus according to claim 1, further comprising a temperature detection unit configured to detect the temperature of the heating member.

5. The image forming apparatus according to claim 1, further comprising a temperature detection unit configured to detect a temperature on a surface of the rotary member.

6. The image forming apparatus according to claim 1, wherein the control unit is configured to control the driving unit such that the endless belt rotates when the temperature of the endless belt is any temperature between 90° C. and 125° C. for rotating when the temperature of the endless belt passes the glass transition temperature of the endless belt from higher than the glass transition temperature of the endless belt to lower than the glass transition temperature of the endless belt.

7. The image forming apparatus according to claim 1, further comprising a temperature detection unit configured to detect the temperature of the endless belt, wherein the control unit is configured to control the driving unit to resume to rotate the endless belt, which is stopped along with the end of the fixing processing, in response to a detection of the temperature of the endless belt to be a predetermined temperature which is higher than the glass transition temperature of the endless belt and lower than a target temperature of the endless belt at the fixing processing.

8. The image forming apparatus according to claim 7, wherein the control unit is configured to control the driving unit to stop the rotation of the endless belt, after resumed to rotate the endless belt, in response to a detection of the temperature of the endless belt to be lower than the glass transition temperature of the endless belt.

9. The image forming apparatus according to claim 1, wherein the timing of starting a rotational movement, the timing which corresponds to the timing of the temperature of the endless belt passing the glass transition temperature of the endless belt from the higher than the glass transition temperature of the endless belt to lower than the glass transition temperature of the endless belt, is determined based on a specified time after the end of the fixing processing.

10. The image forming apparatus according to claim 9, wherein the specified time is determined based on an aggregated number of passing sheets of the recording material.

11. The image forming apparatus according to claim 9, wherein the specified time is determined based on the temperature of the endless belt.

12. The image forming apparatus according to claim 1, further comprising a timer to measure time to resume to rotate the endless belt stopped along with the end of the fixing processing, wherein the control unit is configured to control the driving unit to resume to rotate the endless belt based on an end of a count by the timer.

13. The image forming apparatus according to claim 12, wherein the control unit is configured to control the driving unit to stop to rotate the endless belt based on passing a specified time after resumed to drivingly rotate the endless belt.

14. The image forming apparatus according to claim 1, wherein the endless belt comprises a base layer made of a resin, an elastic layer provided on the base layer, and a releasing layer provided on the elastic layer.

15. The image forming apparatus according to claim 1, wherein the driving unit rotates the rotary member and the endless belt is driven by the rotary member.

* * * * *